US007856683B2

(12) United States Patent
Zheng

(10) Patent No.: US 7,856,683 B2
(45) Date of Patent: Dec. 28, 2010

(54) FOLDABLE COT WITH QUICK LOCK SYSTEM

(76) Inventor: Edward Zheng, 1661Fairplex Dr., La Verne, CA (US) 91750

( * ) Notice: Subject to any disclaimer, the term of this patent is extended or adjusted under 35 U.S.C. 154(b) by 65 days.

(21) Appl. No.: 12/319,538

(22) Filed: Jan. 7, 2009

(65) Prior Publication Data

US 2009/0178195 A1 Jul. 16, 2009

Related U.S. Application Data

(60) Provisional application No. 61/010,422, filed on Jan. 7, 2008.

(51) Int. Cl.
*A47C 19/04* (2006.01)

(52) U.S. Cl. ..... 5/111; 5/110; 5/116; 5/114; 403/341

(58) Field of Classification Search ..... 5/111, 5/110, 114, 116, 117; 403/316, 341, 104, 403/110

See application file for complete search history.

(56) References Cited

U.S. PATENT DOCUMENTS 2,611,906 A * 9/1952 Backer ..... 5/117
2,611,908 A * 9/1952 Siggers ..... 5/114
4,329,076 A * 5/1982 Coreth ..... 403/109.8
4,585,367 A * 4/1986 Gall ..... 403/104
5,555,576 A * 9/1996 Kim ..... 5/114
6,098,218 A * 8/2000 Ventura ..... 5/113
6,618,879 B1 * 9/2003 Wu ..... 5/111
7,155,764 B2 * 1/2007 Sawatzky ..... 5/627
2006/0174415 A1 * 8/2006 Moulton ..... 5/111

* cited by examiner

*Primary Examiner*—Robert G Santos
*Assistant Examiner*—Brittany M Wilson
(74) *Attorney, Agent, or Firm*—Raymond Y. Chan; David and Raymond Patent Firm

(57) ABSTRACT

A foldable cot includes a cot frame includes two longitudinal and a plurality of supporting legs, and a fabric made cot panel, wherein the longitudinal arms are coupled with the longitudinal edge portions of the cot panel respectively. A tensional enhancing arrangement includes two transverse arms coupled with the transverse edge portions of the cot panel, and four coupling joints rotatably mounted with end portions of the transverse arms to couple with four ends of the longitudinal arms respectively, wherein each of the transverse arms is rotated between a releasing position that the cot panel is loosely supported by the longitudinal arms and the transverse arms, and a setup position that the cot panel is stretched towards the four peripheral edges thereof for enhancing a tension of the cot panel.

16 Claims, 9 Drawing Sheets

FOLDABLE COT WITH QUICK LOCK SYSTEM

CROSS REFERENCE OF RELATED APPLICATION

This is a non-provisional application of a provisional application having an application No. 61/010,422 and a filing date of Jan. 7, 2008.

BACKGROUND OF THE PRESENT INVENTION

1. Field of Invention

The present invention relates to a foldable cot, and more particularly relates to a foldable cot with quick lock system, wherein the foldable cot provides a tension feature of enhancing a tension of cot panel when unfolded.

2. Description of Related Arts

Many different kinds of the existing portable cots are used around the world. They usually use as outdoor activities such as camping, fishing, and the like. Moreover, such coats can also be used as extra bed for regular use and as an emergency bed for a wide variety of usage.

A typical portable cot includes a pair of side rails, each side rail having a plurality of section which are interconnected in a manner permitting folding the side rails, a flexible sheet connecting the side rails, and a plurality of support member located beneath the side rails and the flexible sheet for supporting the side rails and the flexible sheet in a horizontal plane. Furthermore, because these portable cots are quite bulky for using, more and more folding cots are design into relatively light and compact size for transportation and storage. Therefore, each side rail typically has a plurality of sections which permits folding each rail at least half. In some cases, the side rails are folded in thirds.

Existing folding cots, in a full-size condition, is long enough in length and is supported by a plurality of support members located beneath the side rails. The flexible sheet of the cot is arranged on the horizontal plane between the side rails by attaching the side edge of the flexible sheet thereon. In other words, the flexible sheet is supported only by the side rails arranged at both longitudinal sides of the cot. The flexible sheet is transversely tensioned on the side rails without any longitudinal supports. Therefore, as the folding cot usually has large size in its longitudinal direction, based on the gravity force, the flexible sheet will be downwardly sagged in the middle along the transverse direction when assemble and unfolded. Therefore, the user obviously needs, but still unavailable, is a full-size folding cot having an enhanced longitudinal tension of the flexible sheet when unfolded.

Moreover, the conventional folding cots, the legs are connected the side rails by hinges, such that they might be folded therewithin. It is typically folded in half such that in the folded position, the length thereof is approximately equal to one-half the length of the cot, the width thereof is equal to the width of the cot, and the depth thereof is only a few inches. While this is a relatively compact size for many purposes, it is not convenient for people to use such that the cots can't spread widely on market.

SUMMARY OF THE PRESENT INVENTION

A main object of the present invention is to provide a foldable cot with quick lock system, which is capable of easily enhancing a tension of a cot panel when unfolded.

Another object of the present invention is to provide a foldable cot with quick lock system, which only occupies a small storage space when disassemble such that the cot can be easily stored and transported.

Another object of the present invention is to provide a foldable cot with quick lock system, which further comprises a lock adjusting arrangement by which a tension of a cot panel is able to be mildly adjusted.

Another object of the present invention is to provide a foldable cot with quick lock system, wherein the foldable cot has an easily assemble parts that can be easily assemble with little effect to form a whole firm cot.

Another object of the present invention is to provide a foldable cot with quick lock system, which is light and durable and the manufacturing cost is relatively low.

Accordingly, in order to accomplish the above objects, the present invention provides a foldable cot, comprising a cot frame which comprises two spaced apart longitudinal arms extending in a parallel manner and a plurality of supporting legs pivotally coupling between the two longitudinal arms;

a fabric made cot panel having four peripheral edges and defining two transverse edge portions and two longitudinal edge portions, wherein the longitudinal arms are coupled with the longitudinal edge portions of the cot panel respectively; and a tensional enhancing arrangement, which comprises:

two transverse arms coupled with the transverse edge portions of the cot panel; and four coupling joints rotatably mounted with end portions of the transverse arms to couple with four ends of the longitudinal arms respectively, wherein each of the transverse arms is rotated between a releasing position that the cot panel is loosely supported by the longitudinal arms and the transverse arms, and a setup position that the cot panel is stretched towards the four peripheral edges thereof for enhancing a tension of the cot panel.

These and other objectives, features, and advantages of the present invention will become apparent from the following detailed description, the accompanying drawings, and the appended claims.

DETAILED DESCRIPTION OF THE PREFERRED EMBODIMENT

Figure 1:
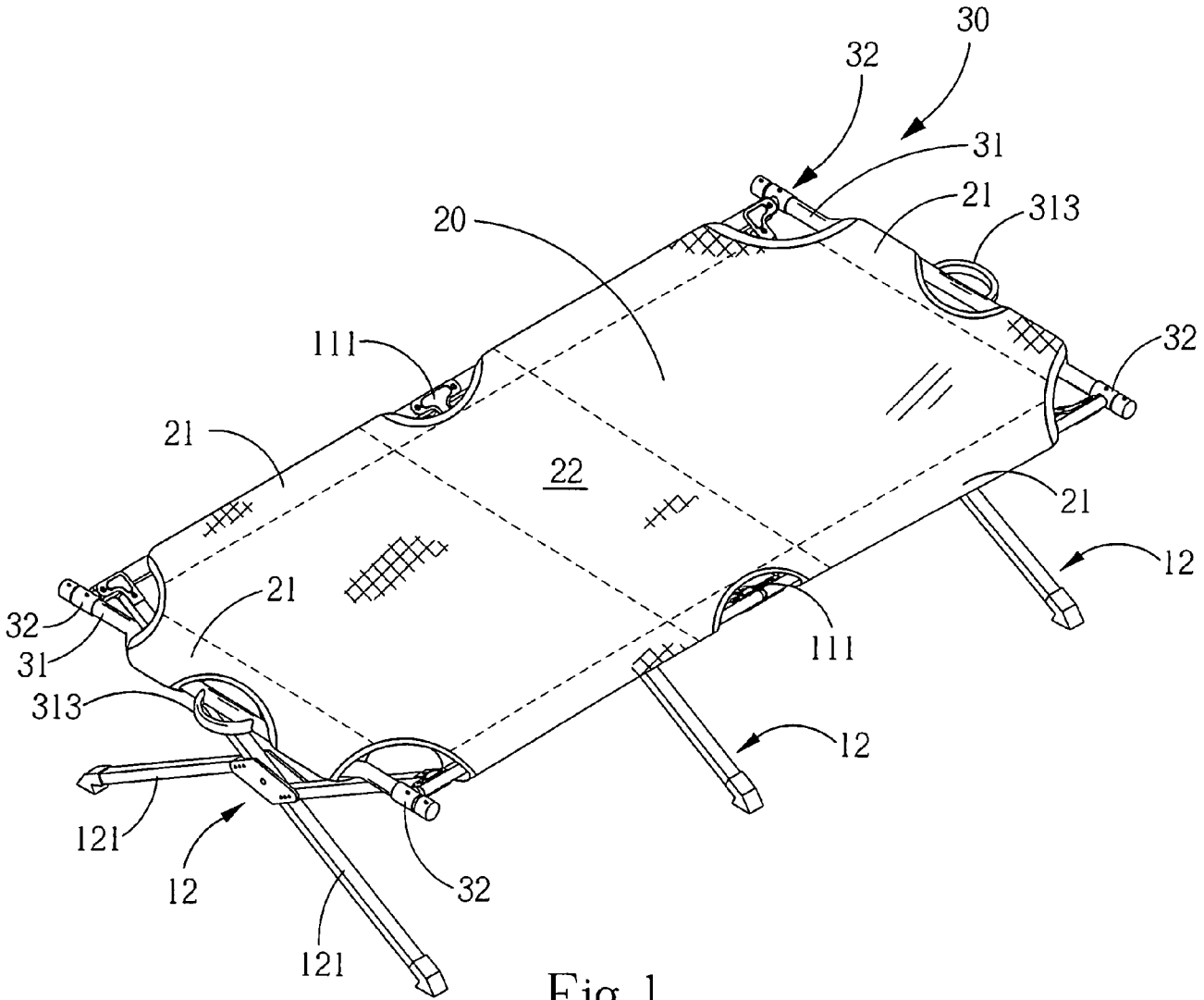
FIG. 1 is a perspective view of a foldable cot with quick lock system according to a preferred embodiment of the present invention.
Figure 2:
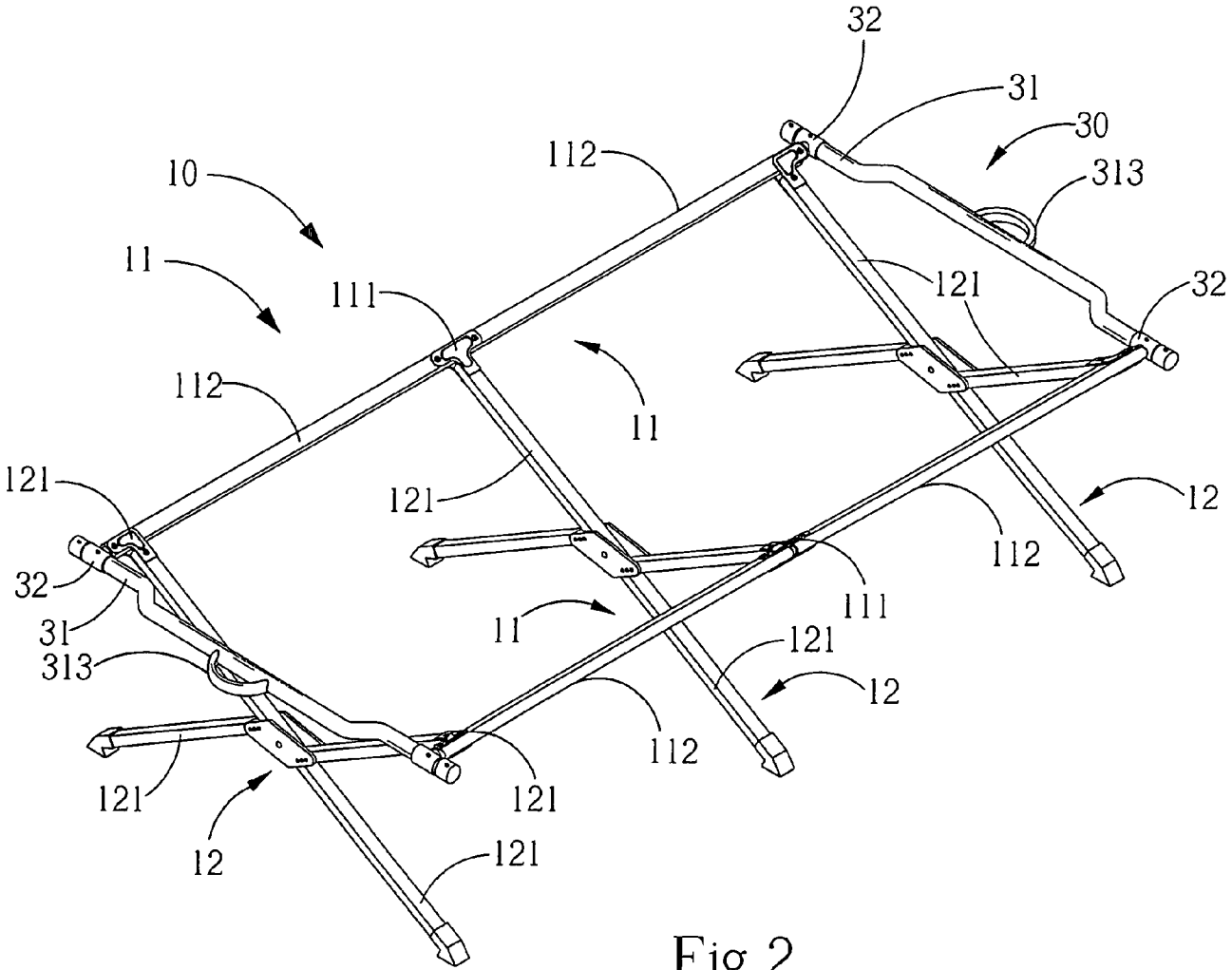
FIG. 2 is a perspective view of a cot frame and a tensional enhancing arrangement of the foldable cot with quick lock system according to the above preferred embodiment of the present invention, which illustrates the cot frame and the tensional enhancing arrangement in an unfold state.

Referring to FIGS. 1 and 2 of the drawings, a foldable cot with quick lock system is illustrated, wherein the foldable cot comprises a cot frame 10, a fabric made cot panel 20 supported by the cot frame 10, and a tensional enhancing arrangement 30 for stretching the cot panel 20 towards four peripheral edges thereof to enhance a tension of the cot panel 20.

The foldable cot is capable of easily and quickly enhancing a tension of a cot panel 20 when unfolded. As in a releasing position, the cot panel 20 is loosely supported by the cot frame 10. When the foldable cot is folded in a set up position, the cot panel 20 is stretched towards the four peripheral edges thereof by the tensional enhancing arrangement 30 for enhancing a tension of the cot panel 20.

The cot frame 10 comprises two spaced apart longitudinal arms 11 extending in a parallel manner and a plurality of supporting legs 12 pivotally coupling between the two longitudinal arms 11.

The fabric made cot panel 20 is mounted on the cot frame 10. The fabric made cot panel 20 has four peripheral edges to define two transverse edge portions and two longitudinal edge portions, wherein the longitudinal arms 11 are coupled with the longitudinal edge portions of the cot panel 20 respectively.

Figure 3:
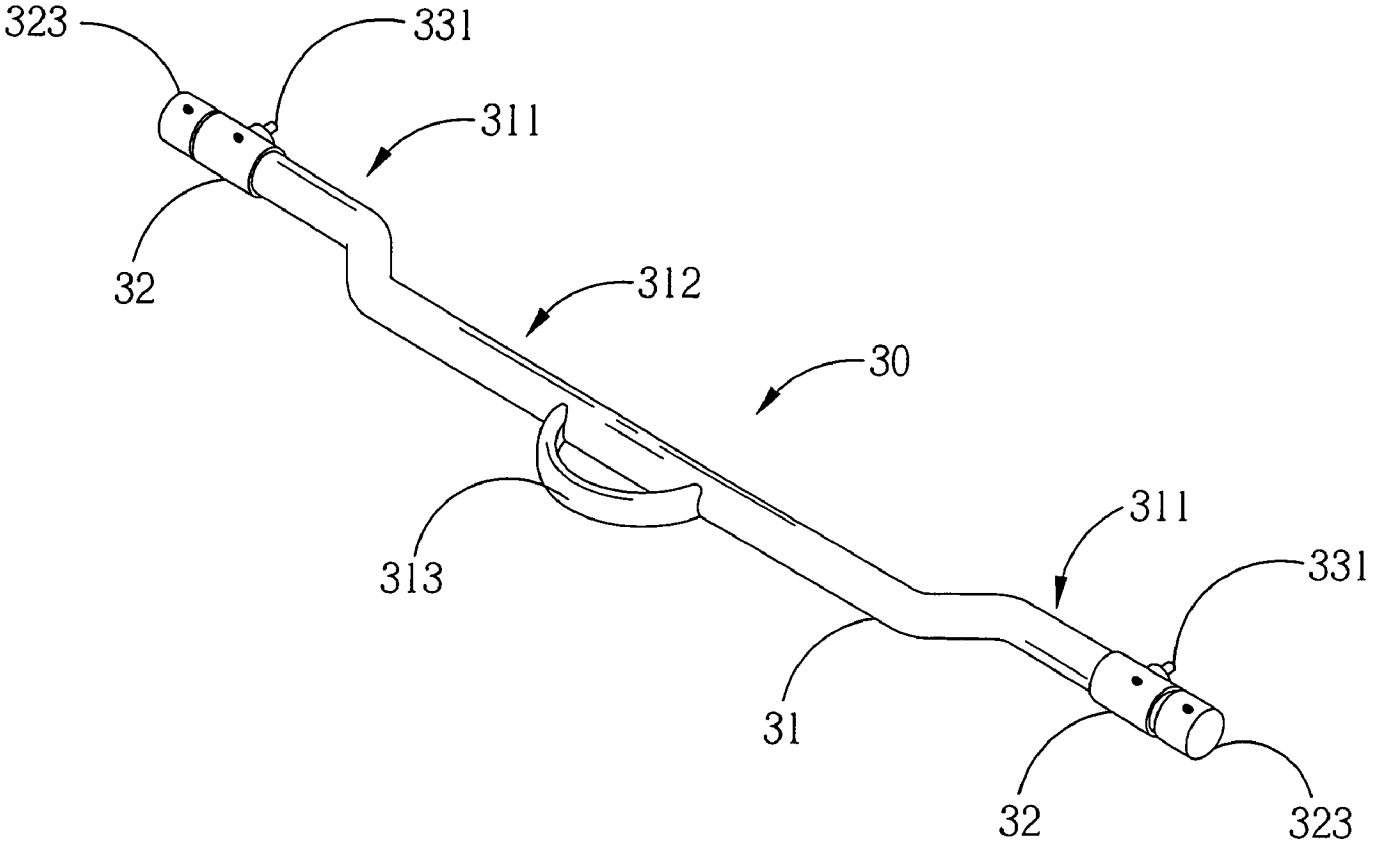
FIG. 3 is a perspective view of the tension enhancing arrangement of the foldable cot with quick lock system according to the above preferred embodiment of the present invention.
Figure 4:
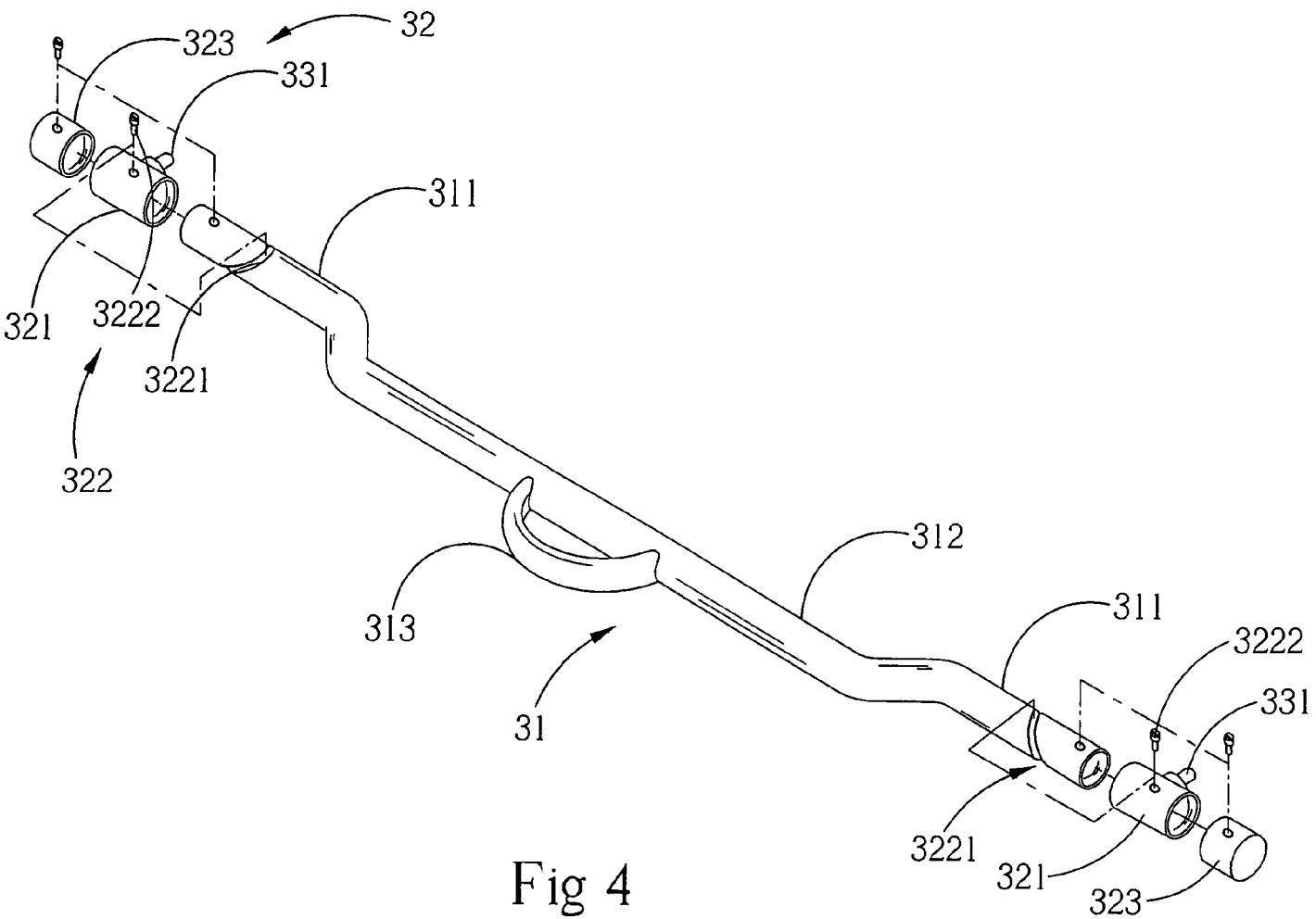
FIG. 4 is an exploded view of the tension enhancing arrangement of the foldable cot with quick lock system according to the above preferred embodiment of the present invention.

The two enhancing arrangement 30, referring to FIG. 3 and FIG. 4 of the drawing, comprise two transverse arms 31 coupled with the transverse edge portions of the cot panel 20, and four coupling joints 32 rotatably mounted with end portions 311 of the transverse arms 31 to couple with four ends of the longitudinal arms 11 respectively. Each of the transverse arms 31 is rotated between the releasing position that the cot panel 20 is loosely supported by the longitudinal arms 11 and the transverse arms 31, and the setup position that the cot panel 20 is stretched towards the four peripheral edges thereof for enhancing a tension of the supporting surface 22 of the cot panel 20.

Figure 5:
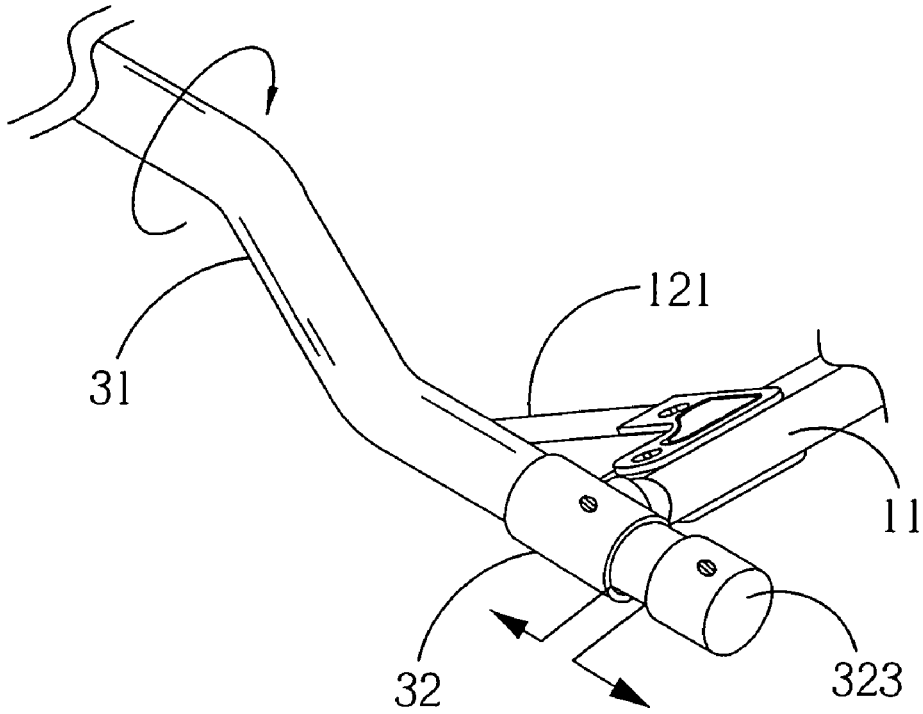
FIG. 5 is a sectional view of the foldable cot with quick lock system according to the above preferred embodiment of the present invention, which illustrates the tensional enhancing arrangement to lock the cot panel in a releasing position.
Figure 6:
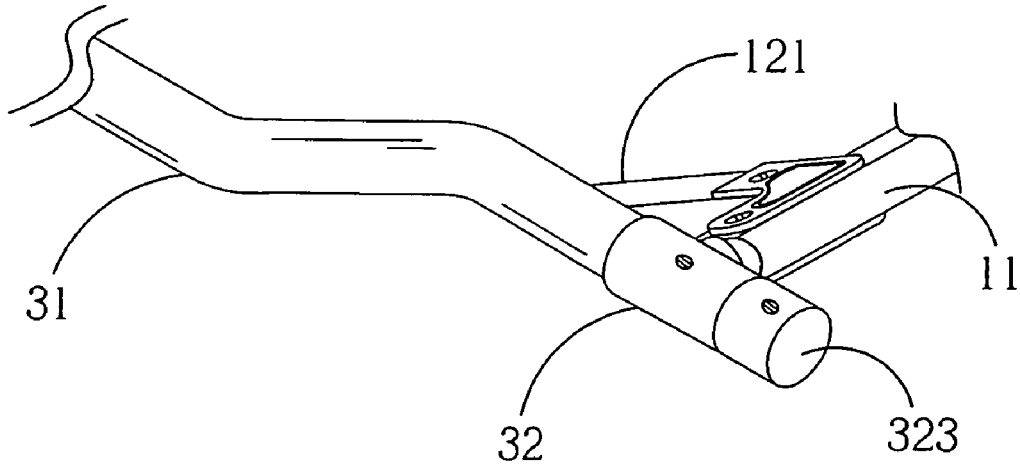
FIG. 6 is a sectional view of the foldable cot with quick lock system according to the above preferred embodiment of the present invention, which illustrates the tensional enhancing arrangement to lock the cot panel in a setup position.

Referring to FIG. 5 of the drawings, when each of the transverse arms 31 is outwardly rotated to each other, the cot panel 20 on the cot frame 10 is stretched towards the four peripheral edges thereof to be quickly locked by the tensional enhancing arrangement 30 in the setup position for enhancing the tension of the cot panel 20. In the other hand, when each of the transverse arms 31 is inwardly rotated to each, referring to FIG. 6 of the drawing, the cot panel 20 arranged on the cot frame 10 is unlocked by the tensional enhancing arrangement 30 in the releasing position for being loosely supported by the longitudinal arms 11 and the transverse arms 31.

It is worth to mention that each of said transverse arms 31 has a "Ω" shape that a mid-portion 312 of the transverse arm 31 is bent to eccentrically extended between two end portions 311 thereof, such that when the transverse arms 31 are rotated outwardly, the mid-portions 312 the transverse arm 31 are folded apart from each other to stretch the cot panel 20 at a longitudinal direction, and when the transverse arms 31 are rotated inwardly, the mid-portions 312 of the transverse arm 31 are folded towards each other to release the tension of the cot panel 20.

Referring to FIG. 4 of the drawing, each of the coupling joints 32 comprises a tubular sleeve 321 coaxially coupled with the respective transverse arm 31 and a guiding track 322 guiding a rotational movement of the transverse arm 31. Each of the coupling joints 32 is not only coupled with the respective transverse arm 31, but also detachably mounted on the respective longitudinal arms 11. The guiding tracks 322 are not only guiding the movement of the transverse arms 31 at a longitudinal direction, but also guiding the movement of the transverse arms 31 at a transverse direction. Therefore, when each of the transverse arms 31 is outwardly rotated, the two corresponding coupling joints 32 are outwardly slide along the transverse arm 31 to slide the longitudinal arms 11 close to each other to release the cot panel 20 at the transverse direction. Additional, each coupling joint 32 further comprises a location terminal 323 coaxially coupled on the respective transverse arm 31 for further locating the coupling joint 32 thereon.

Figure 8:
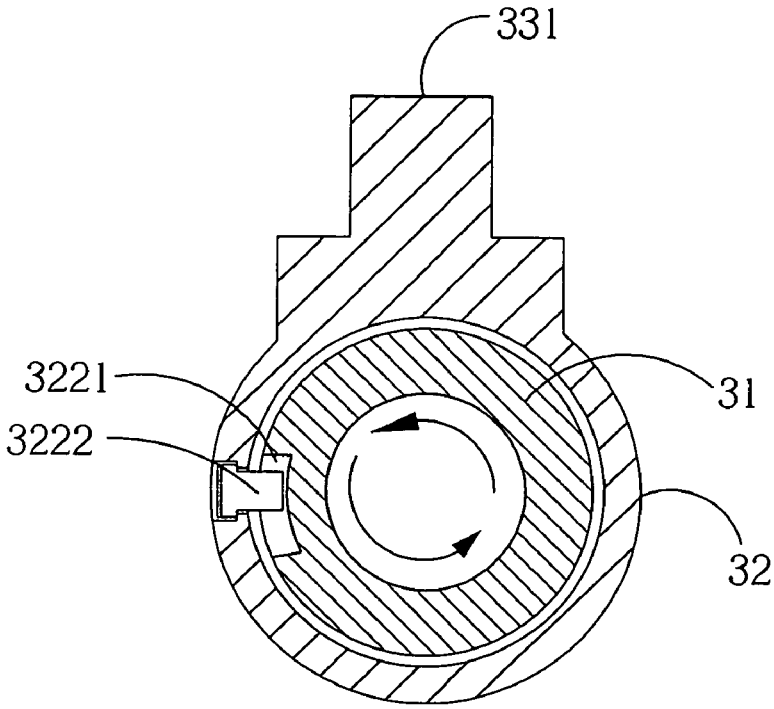
FIG. 8 is a cross section view of a coupling joint of the foldable cot with quick lock system according to the above preferred embodiment of the present invention, illustrating the rotational movement of a guiding track for guiding the rotational movement of the transverse arm.

According to the preferred embodiment of the present invention, as shown in FIG. 4 and FIG. 8 of the drawings, each of the guiding tracks 322 has a spiral shaped guiding slot 3221 and sliding guider 3222. The spiral shaped guiding slot 3221 is indently formed at the transverse arm 31. The sliding guider 3222 is protruded from an inner surface of the respective tubular sleeve 321 to slidably engage with the guiding slot 3221. Therefore, when the transverse arm 31 is rotated outwardly, the corresponding coupling joints 32 are slid apart from each other to slide the longitudinal arms 11 apart from each other so as to stretch the cot panel 20 at a transverse direction, and when the transverse arm 31 is rotated inwardly along the transverse arm 31, the corresponding coupling joints 32 are slid toward each other along the transverse arm 31 to slide the longitudinal arms 11 close to each other so as to release the cot panel 20 at a transverse direction.

Referring to FIG. 4 of the drawings, each of the transverse arms 31 has a shaped that the mid-portion 312 of the transverse arm 31 is bent to eccentrically extend between the two end portions 311 thereof. Each of the end portions 311 of the respective transverse arm 31 is coaxially coupled with the tubular sleeve 321 of the respective coupling joint 32. In other wards, the two spiral shaped guiding slots 3221 are formed at two end portions 311 of the respective transverse arm 31 respectively. Correspondingly, each of the sliding guiders 3222 protruded from the inner surface of the respective tubular sleeve 321 of the respective coupling joint 32 is slidably engaged with the corresponding spiral shaped guiding slot 3221 at the end portion 311 of the respective transverse arm 31. As the mid-portion 312 of the respective transverse arm 31 is eccentrically extended between the two end portions 311 thereof, the mid-portion 312 of the two transverse arm 231 are close towards each other along the longitudinal direction when the transverse arms 31 are inwardly rotated, and the mid-portion 312 of the two transverse arms 31 are apart from each other to stretch the cot panel 20 at a longitudinal direction, and when the transverse arms 31 are rotated inwardly, the mid-portions 312 of the transverse arm 31 are folded toward each other to release the tension of the cot panel 20. In the other hand, a rotating handle 313 is provided the mid-portion 312 of the transverse arm 31 for handling the rotational movement of the transverse arm 31.

Figure 7:
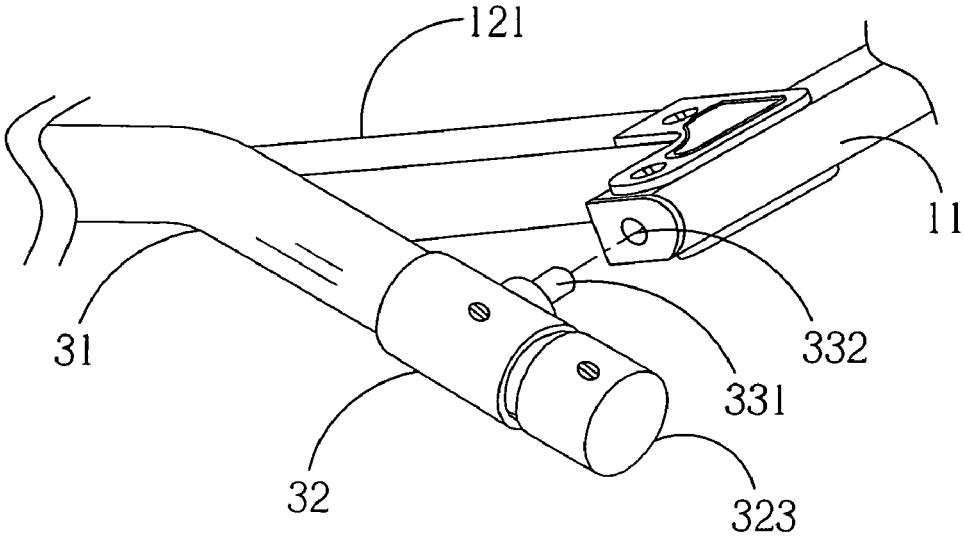
FIG. 7 is a sectional view of the foldable cot with quick lock system according to the above preferred embodiment of the present invention, illustrating a mounting unit for detachably connecting the tensional enhancing arrangement with a longitudinal arm of the cot frame.

Each of the coupling joints 32 is detachably coupled with the end of the respective longitudinal arm 11 to rotate the respective longitudinal arm 11 between the releasing position that the longitudinal arms 11 loosely support the cot panel 20 at the transverse direction, and the setup position that the longitudinal arms 11 tightly stretch the cot panel 20 at the transverse direction for enhancing the tension of the cot panel 20. Referring to FIG. 7 of the drawings, each of the coupling joints 32 comprises a sliding inserter 331 extended from the tubular sleeve 321 thereof for firmly coupling with the respective longitudinal arm 11. Correspondingly, a hollow structure 332 is formed in each end of the respective longitudinal arm 11 for coupling with the sliding inserter 331 of the respective coupling joint 32 therein. The sliding inserter 331 is detachably inserted into the hollow structure 332 of the end of the respective longitudinal arm 11. According to the preferred embodiment of the present invention, the sliding inserter 331 is embodied as a cylindrical post perpendicularly extended from the respective tubular sleeve 32. The hollow structure 332 is embodiment as an indent hole for receiving the cylindrical post correspondingly.

Referring to FIG. 1 of the drawings, the cot panel 20 comprises four holding pockets 21 provided at the peripheral edges thereof, wherein the longitudinal arms 11 and the transverse arms 31 are slidable passing through the holding pockets 21 to be securely retained at the longitudinal edge portions and the transverse edge portions of the cot panel 20 respectively. According to the preferred embodiment of the present invention, the four coupling joints 32 are exposed at the outside of the four holding pockets 21 respectively.

Figure 9:
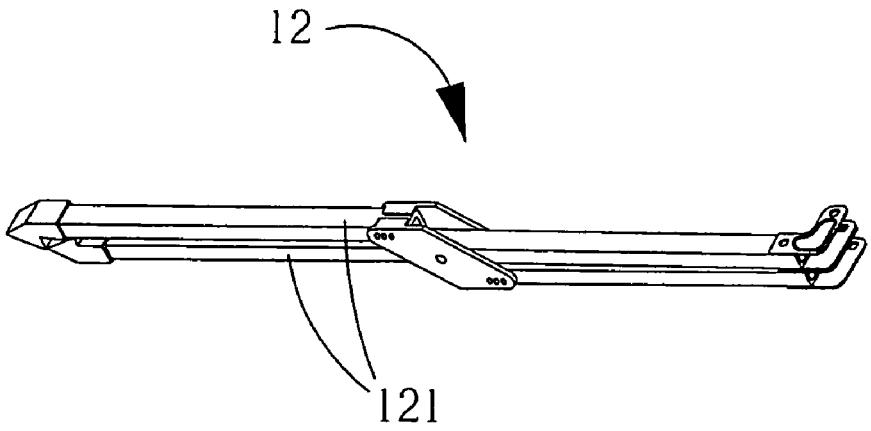
FIG. 9 is a perspective view of a supporting leg of the cot frame of the foldable cot with quick lock system according to the above preferred embodiment of the present invention, illustrating the supporting leg is in a folded state.
Figure 10:
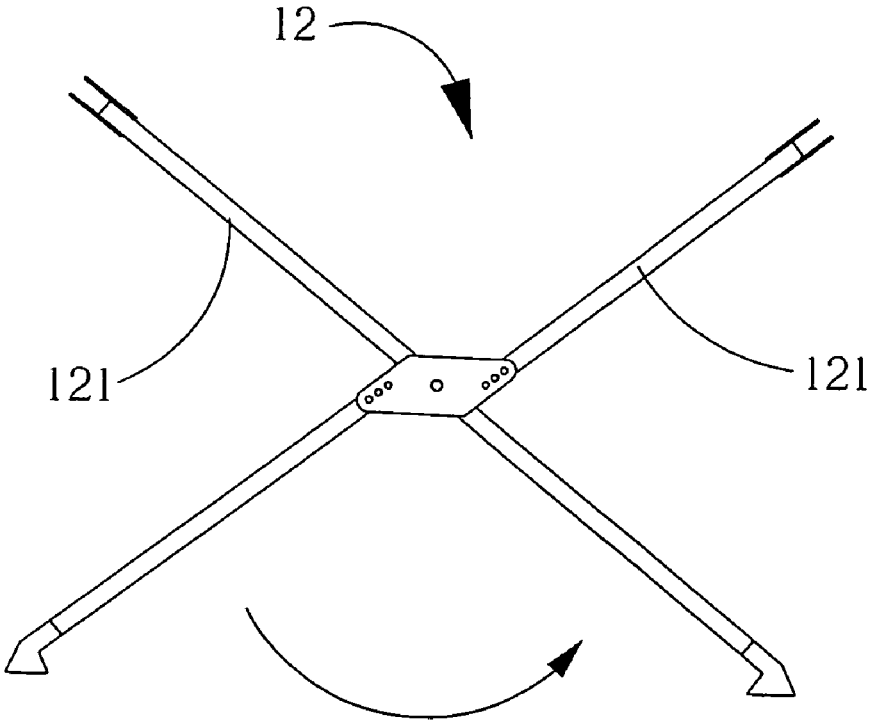
FIG. 10 is a side view of a supporting leg of the cot frame of the foldable cot with quick lock system according to the above preferred embodiment of the present invention, illustrating the supporting leg is in an unfolded state.
Figure 11:
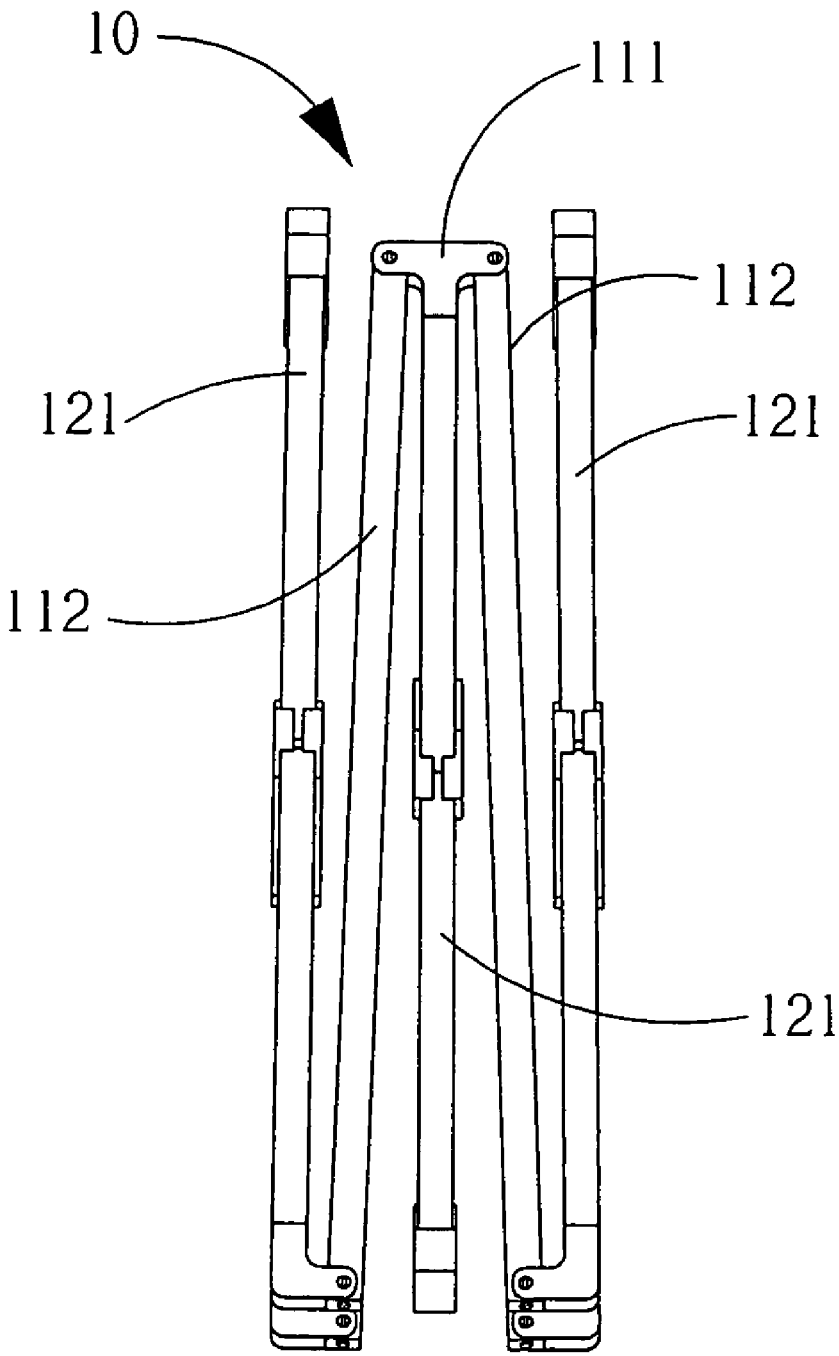
FIG. 11 is a perspective view of the cot frame of the foldable cot with quick lock system according to the above preferred embodiment of the present invention, illustrating the cot frame in a fold state into a relatively small, compact unit for transportation or storage.

According to the preferred embodiment of the present invention, each of the supporting legs 12 comprises two crossed legs 121 pivotally coupling with each other to form a "X" structure, as shown in FIG. 9 and FIG. 10, wherein two upper ends of the crossed legs 121 are pivotally coupled with the longitudinal arms 11 respectively such that when the longitudinal arms 11 are moved alongside to each other, the crossed legs 121 are pivotally folded along the longitudinal arms 11.

In the preferred embodiment, referring to FIG. 1 and FIG. 2 of the drawings, three sets of the supporting legs 12 are spaced apart supported at the longitudinal arm 11 respectively in such a manner to form the cot frame 10 in an unfolded position. Accordingly, two set of the supporting legs 12 are pivotally coupled with the ends of the longitudinal arms 11 and the third set of the supporting leg 12 is pivotally coupled at the mid-portion of the longitudinal arms 11.

According to the preferred embodiment of the present invention, the construct elements of the cot frame 10, such as the longitudinal arms 11, the transverse arms 31, and the supporting legs 12 are made of rigid material such as stainless steal. The cot panel 20 is made of soft material embodied as fabric material. The longitudinal arms 11 and the transverse arms 31 are in tubular shape, and the four peripheral edge portions of the cot panel 20 are coupled with the tubular shape longitudinal arms 11 and the tubular shape transverse arms 31 correspondingly.

The cot frame 10 further comprises two folding joints 111 pivotally coupling at middle section of the longitudinal arms 11 respectively such that each of the longitudinal arms 11 is adapted to be pivotally folded in half at the respective folding joint 111 referring to FIG. 1 and FIG. 2 of the drawing.

Each longitudinal arm 11 typically has a plurality of separated bars 112 which are interconnected in a manner which allows folding each longitudinal arm 11 in half. According to the preferred embodiment of the present invention, each longitudinal arm 11 comprises two separated bars 112 interconnected with each other to form a joint point in the middle thereof, and the respective folding joint 111 is capable of interconnecting the two separated bars 112 together to form the longitudinal arm 11. Therefore, the longitudinal arms 11 are capable of folding in half to allow folding the cot frame 10 into a relatively small, compact unit for transportation or storage.

The cot frame 10 further comprises a reinforcing bar transversely positioned between the two folding joints 111 of the two longitudinal arms 11 for reinforcing the firmness of the cot frame 10.

In order to ensure that the cot frame is net with the certain length demands, the longitudinal arm 11 is capable of being elongated to a needed length by further interconnecting more separated bars 112 to the longitudinal arm 11. Meanwhile, corresponding numbers reinforcing bars 112 are transversely positioned between each folding joint 111 of the two longitudinal arms 11 reinforcing the firmness of longitudinal arm 11 of the cot frame 10.

Figure 12:
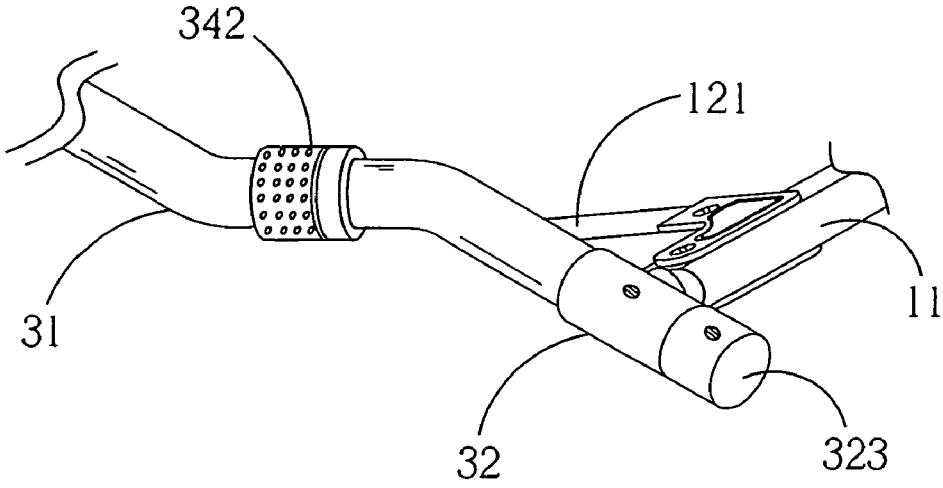
FIG. 12 illustrates an alternative mode of the tensional enhancing arrangement of the foldable cot with quick lock system according to the above preferred embodiment of the present invention.
Figure 13:
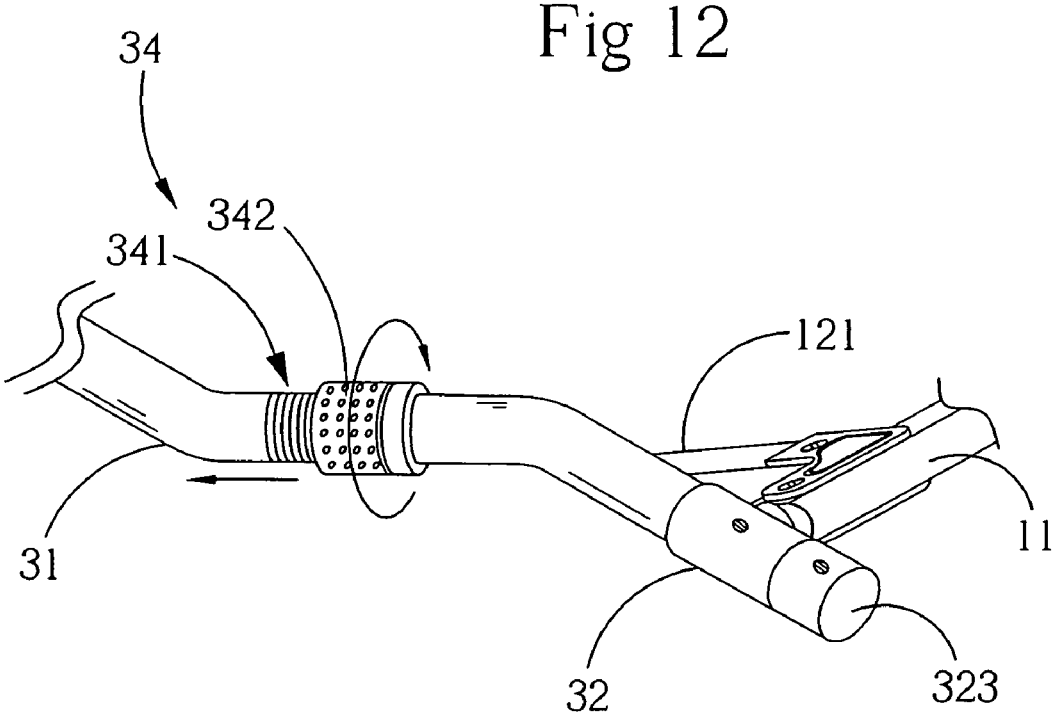
FIG. 13 is a sectional view of alternative mode of the tensional enhancing arrangement of the foldable cot with quick lock system according to the above preferred embodiment of the present invention.

Alternatively, referring to FIG. 12 and FIG. 13 of the drawings, the tensional enhancing arrangement 30 further comprises a tensional adjusting unit 34 provided at the respective transverse arm 31 for adjusting the tension of the cot panel 20 with respect to the cot frame 10. The tensional adjusting unit 34 has two threaded portions 341 spacedly provided at the outer surface of each of the transverse arms 31 and comprises two tension sliders 342 slidably engaged with each of the transverse arms 31 at the outer threaded portions 341 respectively such that when the transverse arm 31 is rotated at one direction, the tension sliders 342 are slid away from each other to adjustably increase the tension of the cot panel 20. When the transverse arm 31 is rotated at an opposite direction, the tension sliders 342 are slid towards each other to adjustably reduce the tension of the cot panel 20. Therefore, by rotating the transverse arms 31, the tensional adjusting unit 34 is capable of selectively adjusting the tension of the cot panel 20 with respect to the cot frame 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable cot, comprising:

a cot frame which comprises two spaced apart longitudinal arms extending in a parallel manner and a plurality of supporting legs pivotally coupling between said longitudinal arms;

a fabric made cot panel having four peripheral edges and defining two transverse edge portions and two longitudinal edge portions, wherein said longitudinal arms are coupled with said longitudinal edge portions of said cot panel respectively; and a tensional enhancing arrangement, which comprises:

two transverse arms coupled with said transverse edge portions of said cot panel; and four coupling joints rotatably mounted with end portions of said transverse arms to couple with four ends of the longitudinal arms respectively, wherein each of said transverse arms is rotated between a releasing position that said cot panel is loosely supported by said longitudinal arms and said transverse arms, and a setup position that said cot panel is stretched towards said four peripheral edges thereof for enhancing a tension of said cot panel, wherein each of said coupling joints comprises a tubular sleeve coaxially coupled with said respective transverse arm and a guiding track guiding a rotational movement of said transverse arm, such that when each of said transverse arms is outwardly rotated, said two corresponding coupling joints are outwardly slid along said transverse arm to stretch said cot panel at a transverse direction, wherein each of said guiding tracks has a spiral shaped guiding slot indently formed at said transverse arm and a sliding guider protruded from an inner surface of said respective tubular sleeve to slidably engage with said guiding slot, such that when said transverse arm is rotated outwardly, said corresponding coupling joints are slid apart from each other, and when said transverse arm is rotated inwardly along said transverse arm, said corresponding coupling joints are slid towards each other along said transverse arm.

2. The foldable cot, as recited in claim 1, wherein each of said transverse arms has a "Ω" shape that a mid-portion of said transverse arm is bent to eccentrically extended between said two end portions thereof, such that when said transverse arms are rotated outwardly, said mid-portions of said transverse arm are folded apart from each other to stretch said cot panel at a longitudinal direction, and when said transverse arms are rotated inwardly, said mid-portions of said transverse arm are folded towards each other to release said tension of said cot panel.

3. The foldable cot, as recited in claim 2, wherein each of said coupling joints is detachably coupled with said end of said respective longitudinal arm.

4. The foldable cot, as recited in claim 3, wherein each of said coupling joints comprises a sliding inserter detachably inserted into said end of said respective longitudinal arm which has a hollow structure.

5. The foldable cot, as recited in claim 4, wherein said cot panel comprises four holding pockets provided at said peripheral edges thereof, wherein said longitudinal arms and said transverse arms are slidably passing through said holding pockets to be securely retained at said longitudinal edge portions and said transverse edge portions of said cot panel respectively.

6. The foldable cot, as recited in claim 5, wherein each of said supporting legs comprises two crossed legs pivotally coupling with each other to form a "X" structure, wherein two upper ends of said crossed legs are pivotally coupled with said longitudinal arms respectively such that when said longitudinal arms are moved alongside of each other, said crossed legs are pivotally folded along with said longitudinal arms.

7. The foldable cot, as recited in claim 6, wherein said cot frame further comprises two folding joints pivotally coupling at mid-portions of said longitudinal arms respectively such that each of said longitudinal arms is adapted to be pivotally folded in half at said respective folding joint.

8. The foldable cot, as recited in claim 5, wherein said cot frame further comprises two folding joints pivotally coupling at mid-portions of said longitudinal arms respectively such that each of said longitudinal arms is adapted to be pivotally folded in half at said respective folding joint.

9. The foldable cot, as recited in claim 4, wherein each of said supporting legs comprises two crossed legs pivotally coupling with each other to form a "X" structure, wherein two upper ends of said crossed legs are pivotally coupled with said longitudinal arms respectively such that when said longitudinal arms are moved alongside of each other, said crossed legs are pivotally folded along with said longitudinal arms.

10. The foldable cot, as recited in claim 4, wherein said cot frame further comprises two folding joints pivotally coupling at mid-portions of said longitudinal arms respectively such that each of said longitudinal arms is adapted to be pivotally folded in half at said respective folding joint.

11. The foldable cot, as recited in claim 3, wherein said cot panel comprises four holding pockets provided at said peripheral edges thereof, wherein said longitudinal arms and said transverse arms are slidably passing through said holding pockets to be securely retained at said longitudinal edge portions and said transverse edge portions of said cot panel respectively.

12. The foldable cot, as recited in claim 3, wherein each of said supporting legs comprises two crossed legs pivotally coupling with each other to form a "X" structure, wherein two upper ends of said crossed legs are pivotally coupled with said longitudinal arms respectively such that when said longitudinal arms are moved alongside of each other, said crossed legs are pivotally folded along with said longitudinal arms.

13. The foldable cot, as recited in claim 2, wherein each of said coupling joints comprises a sliding inserter detachably inserted into said end of said respective longitudinal arm which has a hollow structure.

14. The foldable cot, as recited in claim 2, wherein said cot panel comprises four holding pockets provided at said peripheral edges thereof, wherein said longitudinal arms and said transverse arms are slidably passing through said holding pockets to be securely retained at said longitudinal edge portions and said transverse edge portions of said cot panel respectively.

15. The foldable cot, as recited in claim 1, wherein each of said coupling joints is detachably coupled with said end of said respective longitudinal arm.

16. The foldable cot, as recited in claim 15, wherein each of said coupling joints comprises a sliding inserter detachably inserted into said end of said respective longitudinal arm which has a hollow structure.

* * * * *